US007930867B2

(12) United States Patent
Carvin et al.

(10) Patent No.: US 7,930,867 B2
(45) Date of Patent: Apr. 26, 2011

(54) LOW-SPEED INERTING MEANS AND DEVICE FOR USING SAID INERTING MEANS FOR PACKAGING A FOOD PRODUCT

(75) Inventors: Pascal Carvin, Sollies-Pont (FR); Christian Mura, Le Plan du Castellet (FR)

(73) Assignee: 1/4 VIN, Sollies-Pont (FR)

( * ) Notice: Subject to any disclaimer, the term of this patent is extended or adjusted under 35 U.S.C. 154(b) by 304 days.

(21) Appl. No.: 11/993,881

(22) PCT Filed: Jun. 20, 2006

(86) PCT No.: PCT/FR2006/001391

§ 371 (c)(1), (2), (4) Date: Jun. 16, 2008

(87) PCT Pub. No.: WO2006/136694

PCT Pub. Date: Dec. 28, 2006

(65) Prior Publication Data

US 2009/0100797 A1 Apr. 23, 2009

(30) Foreign Application Priority Data

Jun. 23, 2005 (FR) ..... 05 06422

(51) Int. Cl.
*B65B 31/00* (2006.01)
*B65B 7/28* (2006.01)

(52) U.S. Cl. ..... 53/67; 53/76; 53/510; 53/284.6; 53/307; 53/329.3

(58) Field of Classification Search ..... 53/432, 53/476, 478, 67, 74, 76, 510, 284.5, 284.6, 53/307, 329.3

See application file for complete search history.

(56) References Cited

U.S. PATENT DOCUMENTS

| | | | | |
|---|---|---|---|---|
| 3,191,354 | A * | 6/1965 | McElroy et al. | 53/510 |
| 3,220,153 | A * | 11/1965 | Cormack, Jr. et al. | 53/432 |
| 3,246,447 | A * | 4/1966 | Smith et al. | 53/88 |
| 3,299,607 | A * | 1/1967 | Dopp et al. | 53/510 |
| 3,975,886 | A * | 8/1976 | Waters | 53/310 |
| 4,707,213 | A * | 11/1987 | Mohr et al. | 53/510 |
| 4,729,204 | A * | 3/1988 | Weiss | 53/510 |
| 4,750,312 | A * | 6/1988 | de Vaujany | 53/307 |
| 4,870,801 | A * | 10/1989 | Mizandjian et al. | 53/510 |
| 5,261,870 | A * | 11/1993 | Hammerstedt et al. | 600/35 |
| 5,299,408 | A * | 4/1994 | Dupont | 53/510 |
| 5,452,563 | A * | 9/1995 | Marano et al. | 53/510 |
| 5,509,252 | A * | 4/1996 | Gorlich | 53/510 |
| 6,158,193 | A * | 12/2000 | Focke et al. | 53/76 |
| 6,161,367 | A * | 12/2000 | Walter | 53/307 |
| 6,399,188 | B1 * | 6/2002 | Smith et al. | 428/313.5 |
| 6,629,402 | B1 * | 10/2003 | Zawalick | 53/432 |
| 6,701,692 | B1 | 3/2004 | Niehr | |
| 6,716,275 | B1 * | 4/2004 | Reed et al. | 96/10 |
| 6,745,541 | B2 * | 6/2004 | Sakurazawa | 53/307 |
| 6,912,828 | B1 * | 7/2005 | Yamay | 53/510 |

(Continued)

FOREIGN PATENT DOCUMENTS

| | | |
|---|---|---|
| DE | 32 26 172 A1 | 1/1984 |
| DE | 33 23 710 A1 | 1/1985 |
| EP | 0 352 981 A1 | 1/1990 |

(Continued)

*Primary Examiner* — Stephen F Gerrity
(74) *Attorney, Agent, or Firm* — Young & Thompson

(57) ABSTRACT

Low-speed inerting elements for depleting a receptacle of oxygen, include at least one hollow duct (2232), with walls (2233) of the hollow duct (2232) that are directed towards the receptacle (31) being made of a material including pores.

16 Claims, 5 Drawing Sheets

U.S. PATENT DOCUMENTS

| | | | | |
|---|---|---|---|---|
| 7,464,558 | B2 * | 12/2008 | Huang et al. | 62/51.1 |
| 2003/0019364 | A1 | 1/2003 | Carvin | |
| 2003/0101689 | A1 * | 6/2003 | Guillou | 53/432 |
| 2005/0028487 | A1 | 2/2005 | Winters et al. | |
| 2006/0073241 | A1 * | 4/2006 | Vallentine | 426/106 |

FOREIGN PATENT DOCUMENTS

| | | | |
|---|---|---|---|
| EP | 0 411 769 | A1 | 2/1991 |
| FR | 2 653 408 | A | 4/1991 |
| GB | 1 420 791 | A | 1/1976 |
| WO | 2005/003018 | A1 | 1/2005 |

* cited by examiner

LOW-SPEED INERTING MEANS AND DEVICE FOR USING SAID INERTING MEANS FOR PACKAGING A FOOD PRODUCT

The present application is a National Stage of PCT/FR/2006/001391, filed on Jun. 20, 2006, which claims priority to FR 05/06422, filed on Jun. 23, 2005.

The present invention relates to low-speed inerting means and to a device implementing said inerting means for packaging a foodstuff, in particular a liquid such as wine or an analogous beverage.

BACKGROUND OF THE INVENTION

Document EP 1 235 501 E1 describes a method of packaging wine in a receptacle closed by a capsule. When implementing that method, the receptacle passes in succession via:

- a filler station for filling the receptacle with an inert gas;
- a filler station for filling the receptacle with wine;
- a station for depositing the capsule on the rim of the receptacle;
- a heat-sealing station for sealing the capsule on the receptacle; and
- a post-forming station for shaping the margins of the capsule so as to fold them down against the walls of the receptacle.

The purpose of that method and the associated device is to lengthen the time the wine contained in the receptacle is preserved by limiting the quantity of air in contact with the wine.

In a first variant of that method, the head volume of the receptacle, i.e. the volume situated between the capsule and the surface of the liquid filling the receptacle, is depleted in oxygen, which is particularly useful when the liquid is wine. Oxygen leads to oxidation of wine, thereby making it unsuitable for consumption in the short or medium term.

Document EP 1 235 501 E1 specifies that it can be advantageous to fill the wine receptacle in an inert environment, i.e. an environment made up of an inert gas. Although that is effective, the resulting device becomes particularly complicated since it is necessary to enclose the filler, closure, and heat-sealing stations within an enclosure that is saturated in inert gas in order to isolate the various stations from the surroundings and thus from the surrounding atmosphere. The manufacturing cost of the device and its utilization cost, then become large, in particular because of the large quantities of inert gas that need to be used. In addition, it is found that the large number of stations needed for performing packaging is disadvantageous in terms of cost, maintenance, and bulk. Furthermore, since the enclosure needs to be completely filled with inert gas, the time taken for packaging becomes large, which can lead to a non-negligible loss of revenue.

SUMMARY OF THE INVENTION

The object of the present invention is to propose low-speed inerting means associated with a device for packaging in an ambient atmosphere to package a foodstuff under an atmosphere that is locally inert, as contrasted with devices that perform such packaging in an atmosphere that is generally or even completely inert, for the purpose of minimizing the oxygen content in the head volume so as to preserve the foodstuff from any risk of being oxidized. In addition, given the above-described phenomena, the device is particularly suitable for packaging wine in receptacles.

Furthermore, another object of the present invention is to provide a packaging device presenting a small number of stations for the purposes of simplification and of limiting the cost inherent to fabricating and using the device.

According to the invention, low-speed inerting means for depleting a receptacle of oxygen are provided with at least with one hollow duct, the walls of the duct that are directed towards the receptacle being made of a material having pores, e.g. a ceramic. Under such conditions, the pressure under which the inert gas is injected into the hollow duct advantageously lies in the range 0.1 bars to 3 bars.

The material then advantageously has pores at a density lying in the range 15 pores per inch to 100 pores per inch, with the diameter of a pore being of the order of 5 micrometers (μm) to 100 μm.

In addition, the hollow duct is fed with an inert gas that is heavier than air and that possibly includes a plurality of distinct gases, the inert gas being under pressure so that it can escape from the pores of the hollow duct at a low speed in the form of microbubbles. When, under the action of pressure, the inert gas passes through the pores in the hollow duct, the gas expands on coming into the ambient atmosphere and it forms microbubbles. By definition, the speed of a microbubble of inert gas at this instant is zero. Nevertheless, it is moved away at a very low speed, being driven by the following microbubble. Since the inert gas is heavier than air, it sinks to the bottom of the receptacle and ends up expelling the oxygen that was initially present therein through the top of the receptacle. In addition, since its speed is extremely low, the inert gas does not risk generating any turbulent movements that might, under certain circumstances, trap molecules of oxygen in the receptacle.

Furthermore, in order to optimize inerting, the hollow duct is looped, with its walls that have pores facing towards the receptacle then defining a closed space capable of surrounding the receptacle. In an advantageous variant of the invention, the looped hollow duct forms a ring. Thus, if the receptacle is a glass, inerting takes place uniformly, thereby maximizing its effectiveness. Nevertheless, depending on the shape of the receptacle, other configurations can be envisaged, e.g. a looped duct having a square shape or indeed two distinct hollow ducts that face each other. Similarly, in a variant of the invention in which the hollow duct is not looped, the hollow duct may for example be U-shaped.

According to the invention, the device implementing the above-specified inerting means for acting in an ambient environment to package a foodstuff, such as a liquid or indeed a paste or a solid, for example, in a receptacle under an atmosphere that is locally inert, comprises at least one packaging unit provided with a closure station that includes an inerting unit in its lower portion, the inerting unit being vertically movable and comprising the above-described inerting means. Thereafter, the packaging operation includes a closing stage implemented by the closure station, during which the inerting means depletes or even completely eliminates the oxygen content in the head volume of the receptacle.

Furthermore, the inerting unit includes an end plate that carries the inerting means, said end plate having an empty central zone and being secured to at least two vertically-displaceable columns.

In addition, the closure station also includes an upper portion and an intermediate portion. The upper portion of the closure station is provided with a supply of capsules for closing receptacles that are partially filled with a foodstuff, while the intermediate portion is provided with closure means that are tiltable and vertically displaceable. The closure means, the supply of capsules, and the inerting unit are also disposed on a common axis.

In a variant, the closure means include removable means for shaping the capsules.

In addition, the device is advantageously provided with a U-shaped conveyor having first and second conveyor lines, at least one packaging unit being arranged between the first and second lines. Depending on the desired fabrication throughputs, a greater number of packaging units can be provided.

The function of the conveyor is to take receptacles to the packaging unit. As a security precaution, at least one monitoring sensor is arranged at the inlet to a packaging unit or upstream from the first packaging unit when there are several packaging units, for the purpose of verifying that a receptacle that has already been inerted and closed is not about to penetrate again into a packaging unit. This enables an operator to replace the closed receptacle with a receptacle ready for packaging, for example.

In addition, the device includes control means serving, as a function of the type of receptacle and as a function of requirements, in particular to determine the length of time the inerting means are used during the closing stage.

Furthermore, the foodstuff contained in the receptacle may be constituted in particular by a liquid, a paste, or even a solid, e.g., for example: truffles or salmon tartar. In order to protect and preserve the above-mentioned foodstuffs, it is strongly recommended to isolate them from oxygen. Thus, the present invention is found to be particularly useful and effective.

Under such conditions, prior to proceeding with the closing stage, it is necessary to perform a preliminary step during which the receptacle is filled in part with said foodstuff, i.e. a liquid, a paste, or a solid. It is then clearly possible to envisage placing the closure station of the invention at the end of an existing filler line. Similarly, if the operator uses the variant of the invention that is provided with the above-mentioned U-shaped conveyor, then the operator can place on the conveyor receptacles that have already been filled with a foodstuff, e.g. on some other line.

Nevertheless, if the foodstuff is a liquid, and most particularly wine, then, in a variant of the invention, the packaging unit includes a filler station that is used during a preliminary stage. Thus, during the preliminary stage, the filler station produces a stream of inert gas and a stream of liquid, the inert gas stream surrounding the liquid stream so as to isolate it from the surrounding atmosphere. The filler station then has first and second orifices for producing respectively the liquid stream and the inert gas stream, the second orifice surrounding the first orifice. In this way, the liquid stream does not come into contact with the surrounding atmosphere during a filling stage, and this is particularly advantageous for a liquid that is sensitive to oxidation phenomena, as is the case for wine.

In this configuration, the control means also serve to determine the rate at which the liquid is filled and the length of time for which the liquid is filled.

BRIEF DESCRIPTION OF THE DRAWINGS

The invention and its advantages appear in greater detail in the context of the following description relating to a preferred embodiment and given without any limiting character, with reference to the accompanying figures, in which.

DETAILED DESCRIPTION

Elements present in more than one of the figures are given the same references in each of them.

In addition, FIGS. 1 to 9 relate to a packaging unit provided with a filler station and a closure station including inerting means. The unit is thus well adapted in particular for packaging a liquid. Nevertheless, if the foodstuff for packaging is inserted in the receptacle with the help of means other than the filler station, it will readily be understood that the filler station could be omitted from the packaging unit. However, if the operator desires to preserve the filler station, e.g. for a future use, the operator may be content to deactivate it temporarily by using the control means of the device.

Figure 1:
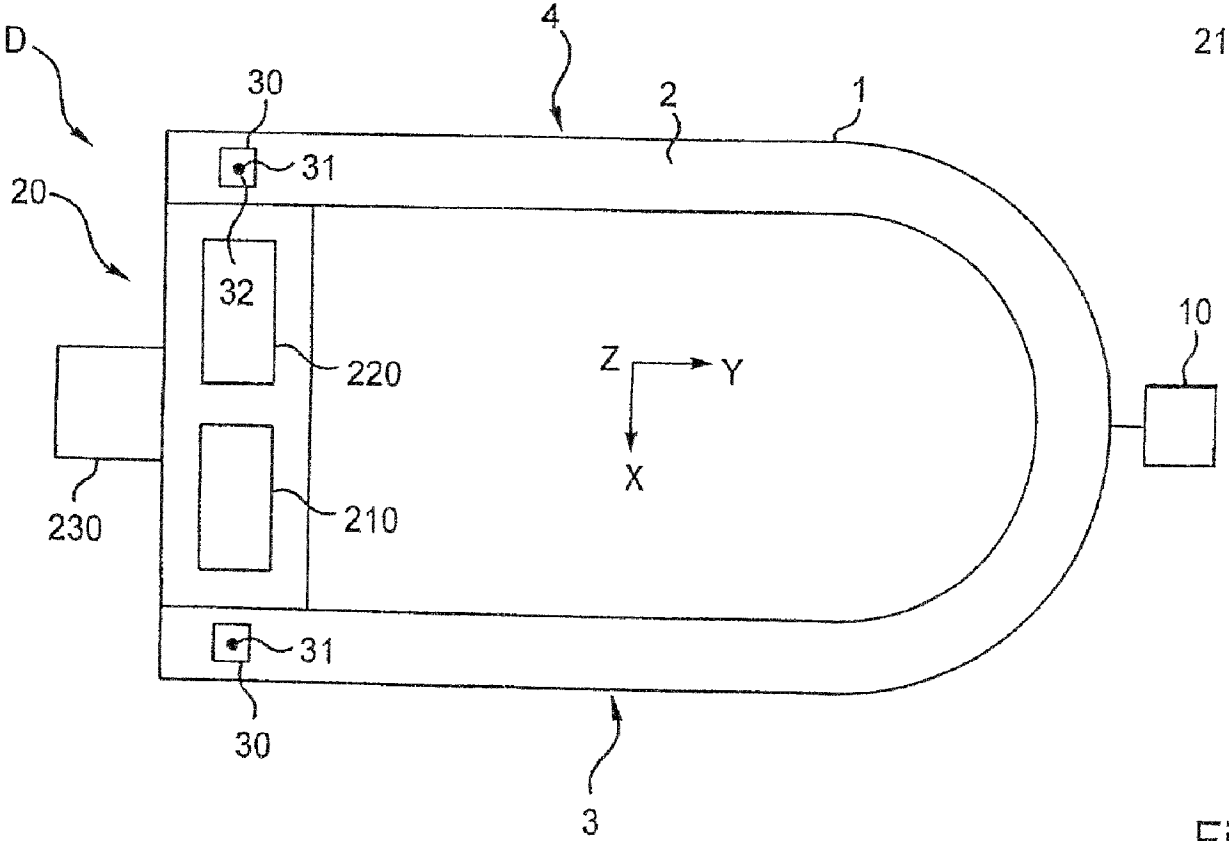
FIG. 1 is a diagrammatic view of the device of the invention.

FIG. 1 is a diagrammatic view showing the device D of the invention as seen looking along the Z axis.

The device comprises a U-shaped conveyor 1 serving to move receptacles 31, e.g. made of glass or plastics, with the help of the usual means, e.g. an assembly conveyor belt 2. In order to ensure that the receptacles 31 are properly positioned and to counter any possible departures from planeness in the conveyor belt 2, the receptacles 31 are placed in pots 30.

The conveyor 1 has first and second lines 3 and 4. Under such conditions, an operator 10 is placed at the bend in the conveyor 1. The operator recovers receptacles 31 that have been packaged by the packaging unit 20 and that are therefore provided with respective capsules 32, and then replaces them with empty receptacles 31. The empty receptacles 31 are thus conveyed by the first line 3 of the conveyor 1 to a packaging unit 20, and, once filled with liquid and closed, they leave via the second line 4 of the conveyor 1. It will naturally be understood that the packaging unit 20 is itself provided with means for moving the assembly comprising a pot 30 and a receptacle 31.

Furthermore, in order to perform its function, the packaging unit has only two stations, a filler station 210 and a closure station 220, the stations serving respectively to perform appropriately a preliminary filling stage and a closing stage. The stations 210, 220 are directly in contact with the surrounding atmosphere, and they are not in contact with an inert atmosphere.

During the preliminary filling stage, the filler station 210 injects a liquid into the receptacle 31, the liquid being isolated from the surrounding atmosphere by a jet of inert gas.

At the end of this stage, the closure station 220 begins the closing stage, during which:

a) closure means take hold of a capsule 32;

b) inerting means deplete the oxygen content of the volume at the top of the receptacle 31, i.e. the volume that lies between the surface of the liquid and the rim of the receptacle 31;

c) the closure means heat-seal the capsule 32 onto the rim of the receptacle; and d) the closure means post-form the edges of the capsule 32 so as to fold them down against the walls of the rim.

In addition, the packaging unit 20 includes control means 230. The control means control the filler and closure stations 210 and 220. In particular, they take into consideration the shape of the receptacle 31, and the nature and the volume of liquid to be poured into the receptacle 31 in order to determine:

the rate and the duration for filling the liquid into the receptacle 31; and the duration of the inerting during step b) of the closing stage.

A plurality of sensors that are not shown are connected to the control means 230, e.g. for the purpose of informing it that an assembly comprising a pot 30 and a receptacle 31 is ready to be filled by the filler station 210. Similarly, it is useful to position a monitoring sensor at the inlet to the packaging unit in order to verify, for example, whether or not a packaged receptacle 31 has been forgotten by the operator 10 and is about to penetrate into the packaging unit. If so, the monitoring sensor sends a signal to the control means to stop the device D so that the operator 10 can remove the receptacle 31 that led to the alarm.

Figure 2:
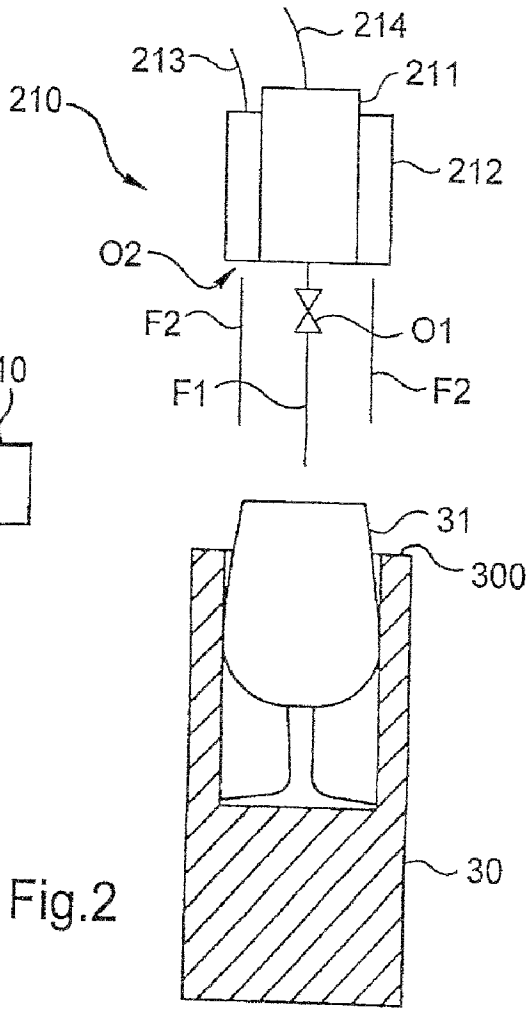
FIG. 2 is a diagrammatic section of a filler station.

FIG. 2 is a diagrammatic section of the filler station 210. It is provided with filler means 211 and isolation means 212 having respective first and second outlet orifices O1 and O2. Furthermore, the filler means 211 and the isolation means 212 are supplied respectively with liquid via a pipe 214 and with inert gas, e.g. nitrogen, via a pipe 213.

Thus, the filler means 211 is capable of expelling a stream of liquid F1 via its first orifice O1, with the isolation means for its part expelling a stream of inert gas F2 via its second orifice O2.

When the assembly comprising the pot 30 and the receptacle 31 comes into position under the filler station 210, the isolation means expels an inert gas stream F2. Thereafter, without stopping the inert gas stream F2, the filler means expels a liquid stream F1, where the liquid can be constituted by wine or spirits, for example.

In addition, the inert gas stream F2 surrounds the liquid stream F1, these streams being concentric, for example, supposing the orifice O2 is ring-shaped. Nevertheless, depending on requirements, it is possible to envisage other geometrical shapes. Similarly, the inert gas stream F2 may present at least one angular detection at its outlet from the orifice O2 so as to be directed towards the liquid stream, e.g. forming a cone.

Consequently, at the beginning of the process, the inert gas stream F2 expels the oxygen away from the receptacle, insofar as the inert gas is a gas heavier than the surrounding air.

Thereafter, during filling proper, the inert gas stream F2 constitutes a kind of curtain that isolates the liquid stream F1 from the surrounding atmosphere. Consequently, the liquid cannot be oxidized during the filling stage, and this is of great importance in particular when it is wine that is being packaged.

Figure 3:
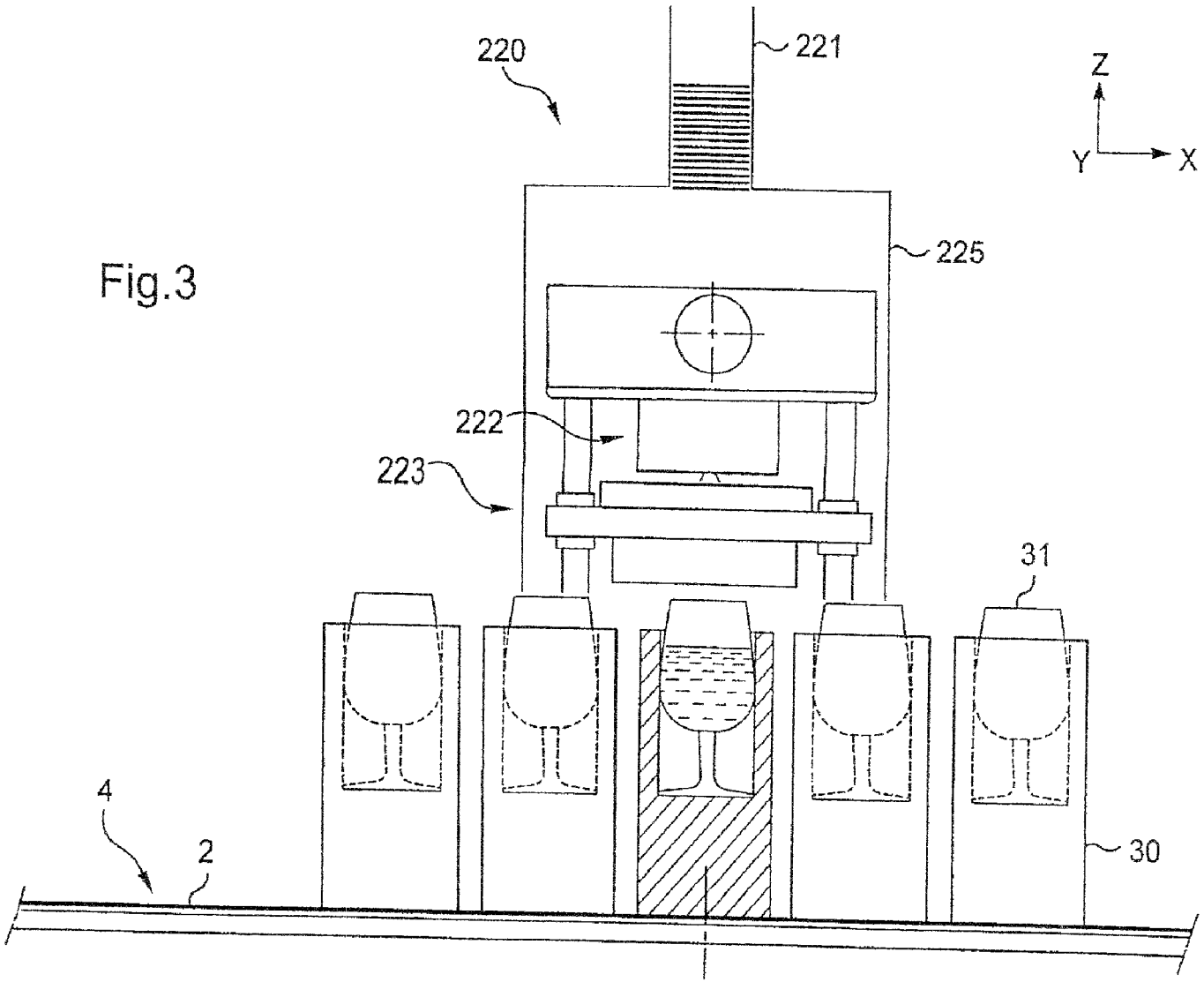
FIGS. 3 and 4 are views looking along two different axes showing a closure station.
Figure 4:
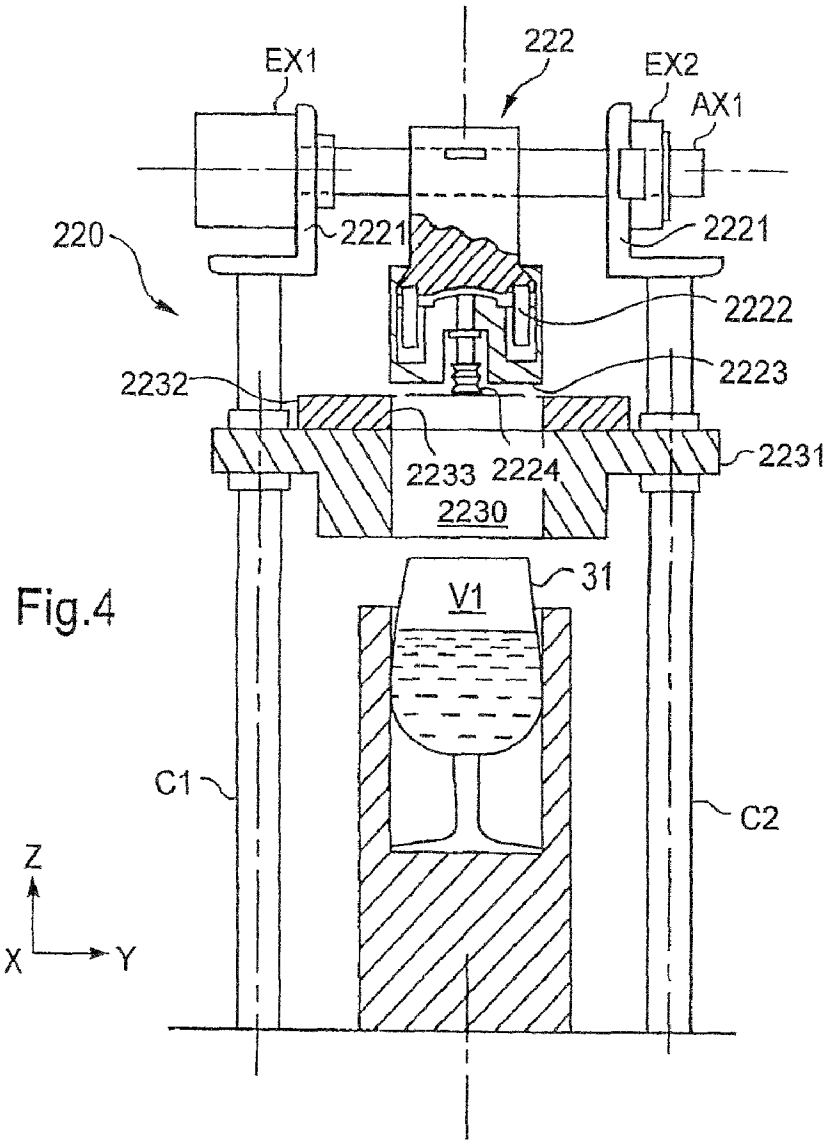

FIGS. 3 and 4 are respective views of the closure station 220 seen looking along the X and Y axes.

The closure station comprises a top portion with a supply 221 of capsules 32 presenting very low permeability, e.g. being made up of a laminated material comprising a layer of pure aluminum coated in a layer of plastics material. The supply 221 is stationary, being secured to the structure 225.

The closure station also includes closure means 222 in its intermediate portion and an inerting unit 223 in its bottom portion.

The inerting unit 223 is movable vertically along the Z axis. It is arranged on two columns C1, C2. These columns are connected to first and second actuators, disposed in series under the packaging unit 20, and consequently under the conveyor 1, being controlled by the control means 230 so as to move vertically from a low position to a high position, passing via a rest position, and vice versa.

In addition, the inerting unit 223 is provided with an end plate 2231 suitable for sliding along the columns C1, C2. The end plate 2231 carries inerting means 2232. The inerting means 2232 and the end plate 2231 have an empty central zone 2230 so as to enable the closure means 222 and the rim of the receptacle 31 to pass therethrough, at least in part.

During step b) of the closing stage, the inerting means 2232 serve to deplete the oxygen content in the head volume V1 of the receptacle 31. For this depletion to be effective, it is performed using a gas that is heavy, e.g. nitrogen.

The inerting means 2232 is a looped hollow duct, in this embodiment specifically a hollow ring, although some other shape could naturally be devised, depending on requirements. It is thus possible to have a hollow duct that is not looped and that then describes a U-shape. Nevertheless, when the hollow duct is looped, the walls 2233 of the duct that are directed towards the receptacle 31 define a closed space surrounding the receptacle 31.

The walls 2233 also include pores, e.g. being made of a ceramic, with the number of pores lying in the range 15 pores per inch to 100 pores per inch. The inert gas is then injected into the inerting unit under a pressure of about 0.1 bars to 3 bars. Under the effect of this pressure, microbubbles of inert gas leave the inerting unit 2232 via the pores in the walls 2233. In this way, the inert gas takes position in the head volume V1 at a speed that is very slow, thereby ensuring that the operation is performed entirely successfully. The duration of the inerting operation is determined by the control means 230 as a function of the shape of the volume V1.

Furthermore, the closure means 222 are arranged on the columns C1, C2 with the arrangement of the closure means 222 on the columns C1, C2 being implemented with the help of a shaft AX1 having ends EX1 and EX2 that pass through two plates 2221.

In addition to being able to move vertically, the closure means is free to tilt through 180° so as to face either the rim of the receptacle 31, or else the supply 221 of capsules 32. For this purpose, the end EX1 of the shaft AX1 is provided with conventional rotary drive means, e.g. a rotary actuator, while the end EX2 is free to turn about its axis of rotation while remaining secured to the plate 2221.

Furthermore, the closure means include heater means 2222 for heating its heating surface 2223, and also a suction cup suitable for taking hold of a capsule.

FIGS. 5 to 9 are used for explaining the stage of closing a receptacle 31 that has penetrated into a closure station 220.

Figure 5:
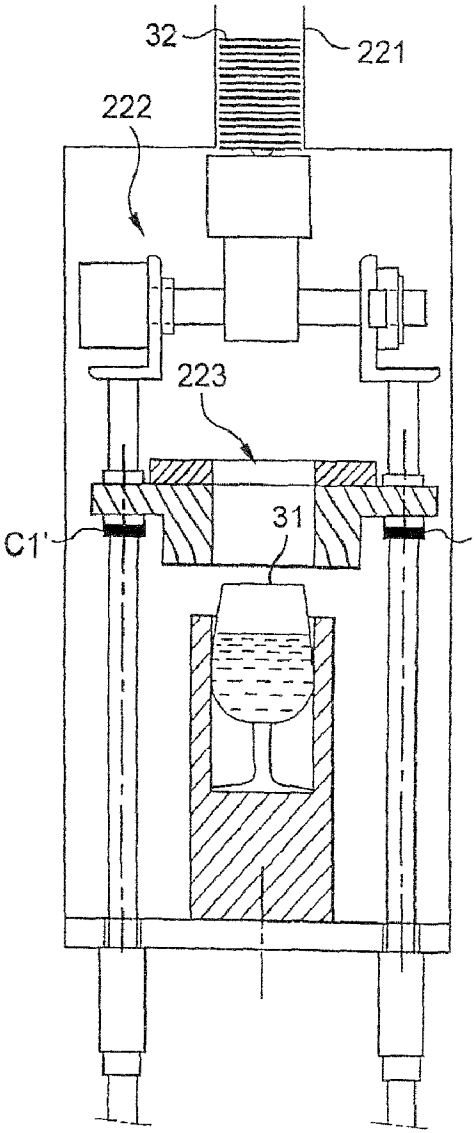
FIGS. 5 to 9 are views explaining the operation of the filler station.

During step a) of the closing stage, shown in FIG. 5, the control means 230 causes the rotary drive means to tilt the closure means 222 to cause them to face the supply 221 of capsules. The first actuator then pushes the columns C1, C2 so as to put the closure means 222 into its high position. Under the pressure exerted by this movement in translation, the suction cup 2224 takes hold of a capsule 32. Since the columns C1, C2 are provided with respective stop rings C1', C2' of conventional type, these stop rings C1, C2' also serve to move the inerting unit 223 in translation when the first actuator pushes the columns C1, C2.

Figure 7:
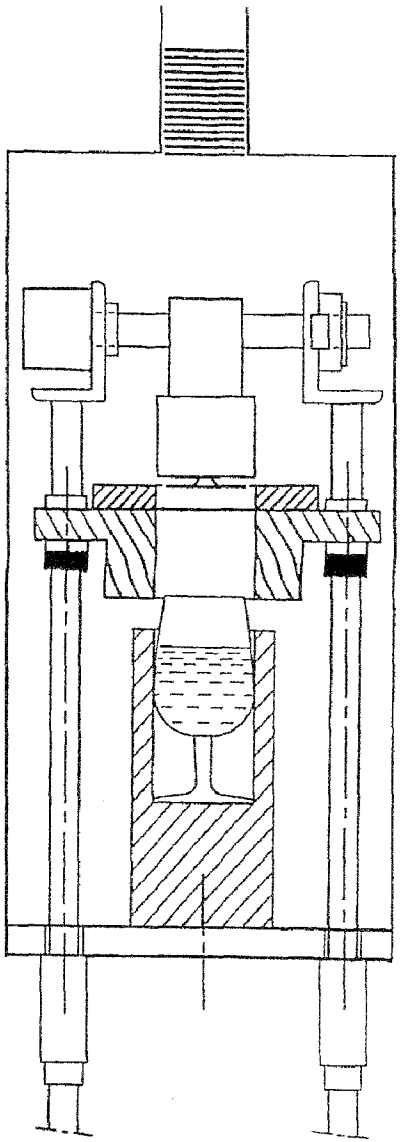
Figure 6:
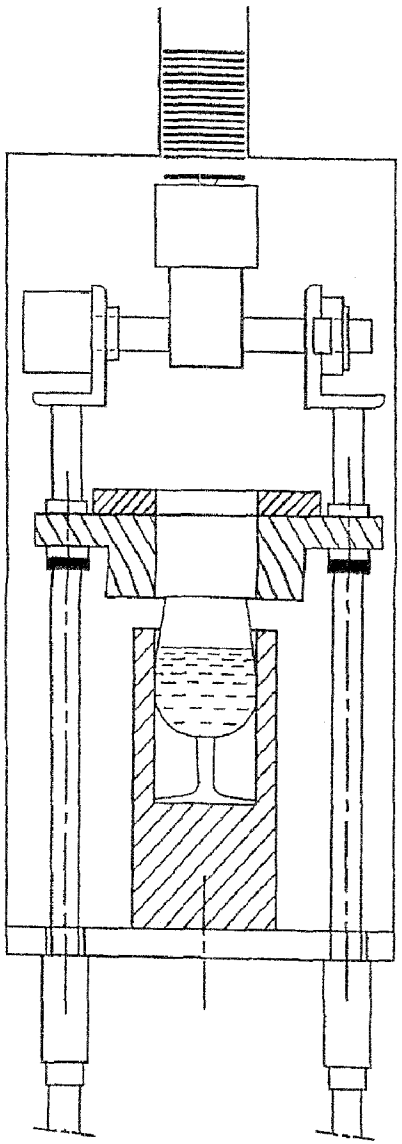

At the end of this step, as shown in FIG. 6, the control means move the closure means 222 by means of the first actuator. Because of their weight, the inerting means 223 cause the columns C1, C2 to slide until they reach the stop rings C1', C2'. Thereafter, as shown in FIG. 7, the control means cause the rotary means to tilt the closure means 222 so as to make the closure means face the rim of the receptacle. The assembly comprising the inerting means 223 and the closure means 222 is then in its rest position.

Figure 8:
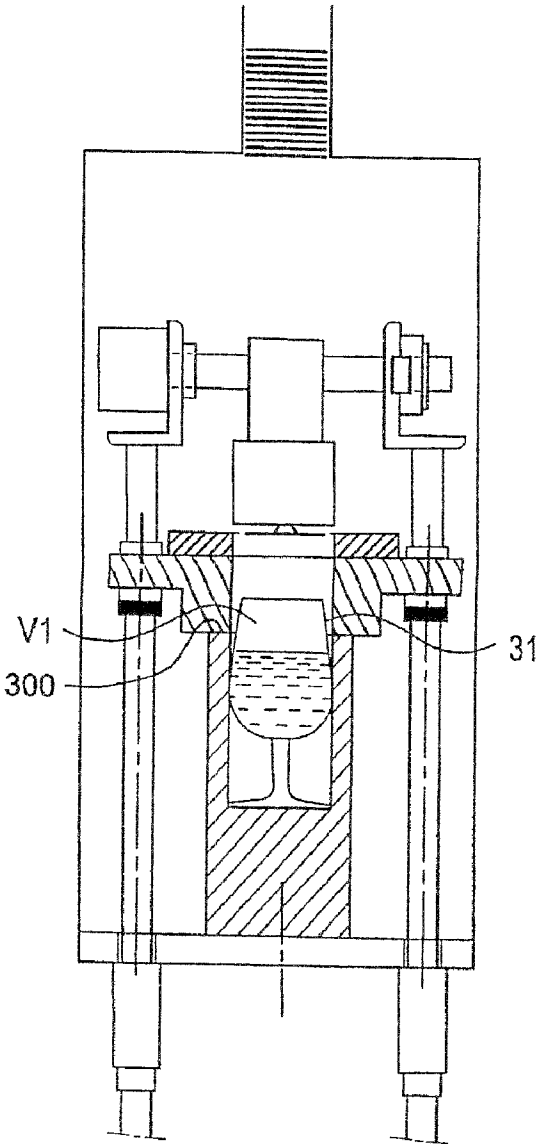

With reference to FIG. 8, step b) of the closing stage can begin. The control means 230 then causes the second actuator to move the columns C1, C2 downwards, thereby moving the inerting unit 223 and the closure means 222 downwards in translation.

The end plate 2231 is then pressed against the rim 300 of the pot 30. Inert gas that has been injected into the inerting means 2232 escapes therefrom at a low speed in the form of microbubbles. Because of its weight, it ends up by completely filling the head space V1 in the receptacle, consequently expelling any oxygen that might have been present therein.

In parallel, the control means causes the heater means 2222 of the closure means 222 to heat its heater surface 2223. A temperature probe (not shown) advantageously informs the control means when the desired temperature is reached.

Figure 9:
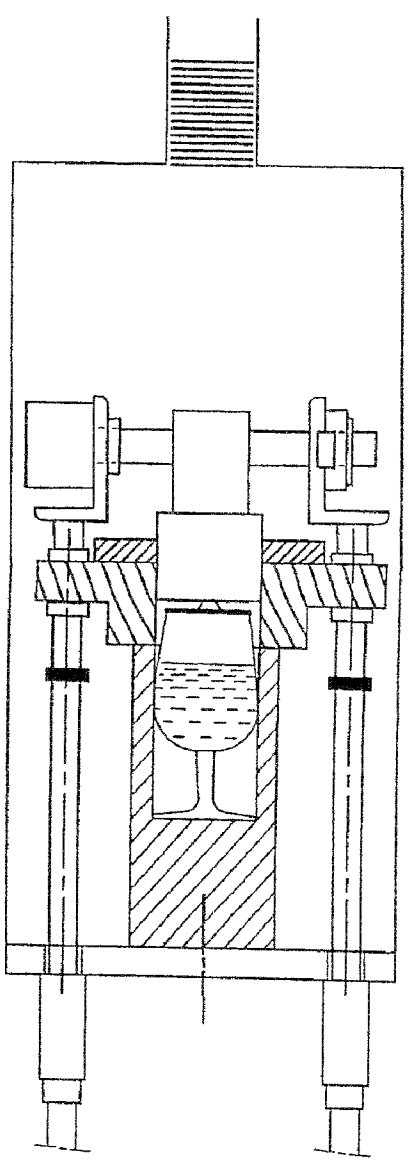

As shown in FIG. 9, the closure means then come into action to heat-seal the previously-taken capsule 32. The control means 230 causes the second actuator to lower the closure means 222 fully so as to press the capsule 32 against the rim of the receptacle. Since the inerting unit 223 is held against the rim 300 of the pot 30, it does not move.

The flexibility of the suction cup 2224 means that it does not prevent the heater surface 2223 from pressing the capsule 32 against the rim of the receptacle.

Under the effect of the heater surface, and also under the bearing force with which the capsule is pressed against the receptacle, the treatment of the metal layer of the capsule rises, thereby raising the temperature of the plastics film of the capsule that is in contact with the rim of the glass, and as a result causing it to adhere to the receptacle.

Depending on requirements, the heater surface is at a temperature lying in the range 80° C. to 350° C. Similarly, the bearing force is preferably situated in a range of 10 decanewtons (daN) to 255 daN. For this purpose, the second actuator is further controlled in pressure so as to enable said bearing force to be adjusted accurately.

Finally, the heater surface may be provided with shaper means (not shown) enabling the capsule to be post-formed by folding its margins down onto the outside walls of the rim of the receptacle. Such shaper means are adapted to the shape of the receptacle. Consequently, the shaper means are removable, being fastened to the heater surface by conventional means.

Naturally, the present invention is capable of numerous variations concerning its implementation. Although an embodiment is described above, it will readily be understood that it is not conceivably possible to identify exhaustively all possible embodiments. It is naturally possible to envisage replacing any of the means described by equivalent means without going beyond the ambit of the present invention.

What is claimed is:

1. A device for acting in a surrounding environment to package a foodstuff in a receptacle under an atmosphere that is locally inert, the device comprising:

at least one packaging unit provided with a closure station having an inerting unit in its lower portion; and at least one monitoring sensor to verify that an already-closed receptacle is not penetrating into the packaging unit, wherein said inerting unit including inerting means comprising at least one hollow duct having walls, the walls of said hollow duct that are directed towards said receptacle being made of a material including pores, said hollow duct being fed with an inert gas under pressure, said inerting means having an empty central zone.

2. A device according to claim 1, wherein said material has pores at a density lying in the range 15 pores per inch to 100 pores per inch.

3. A device according to claim 1, wherein said material is a ceramic.

4. A device according to claim 1, wherein said pressure enables said inert gas to escape from said pores at low speed.

5. A device according to claim 1, wherein said hollow duct is looped, said walls defining a closed space capable of surrounding said receptacle.

6. A device according to claim 5, wherein said looped hollow duct is in the form of a ring.

7. A device according to claim 1, wherein said inerting unit includes an end plate carrying said inerting means, said end plate having an empty central zone.

8. A device according to claim 7, wherein said end plate is secured to at least two vertically-displaceable columns.

9. A device according to claim 1, wherein a top portion of said closure station is provided with a supply of capsules.

10. A device according to claim 1, wherein an intermediate portion of said closure station is provided with closure means that are tiltable and vertically displaceable.

11. A device according to claim 10, wherein said closure means include removable shaper means.

12. A device according to claim 1, including control means.

13. A device according to claim 1, wherein said inerting unit is displaceable vertically.

14. A device for acting in a surrounding environment to package a foodstuff in a receptacle under an atmosphere that is locally inert, the device comprising:

at least one packaging unit provided with a closure station having an inerting unit in its lower portion; and a filler station that produces a stream of inert gas and a stream of liquid, said inert gas stream surrounding said liquid stream to isolate it from said surrounding atmosphere, wherein said inerting unit including inerting means comprising at least one hollow duct having walls, the walls of said hollow duct that are directed towards said receptacle being made of a material including pores, said hollow duct being fed with an inert gas under pressure, said inerting means having an empty central zone.

15. A device according to claim 14, wherein said filler station includes first and second orifices for producing said liquid and inert gas streams respectively, said second orifice surrounding said first orifice.

16. A device according to claim 14, wherein said inerting unit includes an end plate carrying said inerting means, said end plate having an empty central zone.

* * * * *